US006085916A

United States Patent [19]

Kovacevic et al.

[11] Patent Number: 6,085,916

[45] Date of Patent: Jul. 11, 2000

[54] DEMOUNTABLE HANGER BAR

[75] Inventors: Ivica Kovacevic, Mississauga; Colin Wendell Mathlin, Oshawa; David Fredrick Didur; Paul Kenneth Wolff, both of Toronto; David Melbye, Mississauga; Sarah Katharine Barnes; Carol-Ann Ursa, both of Toronto; Todd Christopher Langille, Alton; Stephen Kenneth Cox, Richmond Hill; Steve Singh, Scarborough, all of Canada

[73] Assignee: Seven Continents Enterprises Incorporated, Toronto, Canada

[21] Appl. No.: 09/048,797

[22] Filed: Mar. 27, 1998

[51] Int. Cl.[7] ..... A47F 5/00; A47F 5/08

[52] U.S. Cl. ..... 211/86.01; 211/87.01

[58] Field of Search ..... 211/87.01, 105.3, 211/86.01; 248/206.5

[56] References Cited

U.S. PATENT DOCUMENTS

| | | | |
|---|---|---|---|
| D. 299,212 | 1/1989 | Murphy . | |
| 874,014 | 12/1907 | Kurtzon | 211/87.01 X |
| 1,416,969 | 5/1922 | O'Conner | 211/87.01 X |
| 2,196,965 | 4/1940 | Bryan | 211/87.01 X |
| 2,948,407 | 8/1960 | Wiszuk . | |
| 2,965,235 | 12/1960 | Daline | 211/87.01 X |
| 3,017,036 | 1/1962 | Albert . | |
| 3,023,991 | 3/1962 | Fisher . | |
| 3,223,898 | 12/1965 | Bey | 248/206.5 X |
| 3,254,528 | 6/1966 | Michael | 248/206.5 X |
| 3,361,404 | 1/1968 | Lohr . | |
| 3,853,293 | 12/1974 | Larson | 211/86.01 X |
| 4,223,862 | 9/1980 | Doughty . | |
| 4,480,361 | 11/1984 | Morita | 248/206.5 X |
| 4,638,786 | 1/1987 | Lucky | 248/206.5 X |
| 4,702,382 | 10/1987 | Hoshino | 211/86.01 X |
| 4,875,654 | 10/1989 | Chandonnet et al. | 248/206.5 X |
| 4,891,897 | 1/1990 | Gieske . | |
| 4,971,210 | 11/1990 | Blumenkranz . | |
| 5,083,668 | 1/1992 | Bushey . | |
| 5,137,158 | 8/1992 | Brockway . | |
| 5,186,331 | 2/1993 | Zeld . | |
| 5,236,095 | 8/1993 | Krizka | 211/105.3 X |
| 5,417,397 | 5/1995 | Harnett | 248/206.5 X |
| 5,501,342 | 3/1996 | Geibel | 248/206.5 X |
| 5,609,317 | 3/1997 | Glynn et al. | 248/206.5 |
| 5,630,517 | 5/1997 | Maznik | 248/206.5 X |
| 5,642,871 | 7/1997 | Repert et al. | 248/206.5 X |
| 5,730,513 | 3/1998 | Lemon et al. | 211/87.01 X |
| 5,794,800 | 8/1998 | Carmo et al. | 211/87.01 X |
| 5,813,549 | 9/1998 | Sheehan et al. | 211/87.01 |
| 5,853,092 | 12/1998 | Goodman et al. | 211/87.01 X |

*Primary Examiner*—David M. Purol
*Assistant Examiner*—Erica B. Harris

[57] ABSTRACT

A demountable hanger assembly, for mounting at various locations in a display panel, has a cylindrical socket of predetermined diameter, a magnet mounted within the socket; a hanger locating device mounted within the socket adjacent to the magnet; a hanger member having a cylindrical portion to make a snug sliding fit in the socket, the cylindrical portion at least being formed of a magnetically sensitive material, attracted to the magnet, a locating recess formed in the cylindrical member to interfit with the locating member in the socket; and a hanger extending outwardly from the cylindrical portion, the hanger member being demountable from and mountable in the socket by manually separating the cylindrical member from the magnet.

16 Claims, 5 Drawing Sheets

DEMOUNTABLE HANGER BAR

FIELD OF THE INVENTION

The invention relates to a demountable hanger and in particular to such a hanger bar which may be typically used in a retail product display such as display of clothing in a retail store for sale, and in which the hanger bar may be moved from place to place.

BACKGROUND OF THE INVENTION

In-store displays for hanging product for sale are used in a wide variety of forms. Particularly in the display of clothing, numerous different items of clothing may be hung for display in a retail store. The clothing may be full-length coats, jackets, suits, sweaters, shirts or other items. The hanging and display of such items may require the hangers to be positioned at different locations in the store and at different heights. Some such hangers may be further apart and others closer together.

These features make for flexibility in the design and layout of the interior of the store and a display of the product, and will satisfy the desire of the retailer to be able to rearrange his display from time to time with a minimum of trouble.

In the design of such dismountable display hangers, it is desirable that, as far as possible, when the actual hanger bar is removed, the wall fixture supporting the hanger shall remain in the wall or other panel and the substrate on which it is supported shall appear, as far as possible, smooth and undisturbed and fit in with the general decor and design of the store interior.

Hanging systems involving vertical rails are available, with the rails attached to the walls or substrates, and hangers can be positioned at different locations on the rails. However the rails are usually located in the walls at fixed spaced intervals, and this leads to a somewhat inflexible arrangement. In addition, when the rails are not occupied for the purpose of hanging clothing, they create a rather obvious obtrusive appearance in the store which may be undesirable. One improved form of product display is shown in U.S. Pat. No. 5,186,341, dated Feb. 16, 1993, inventor Michael R. Zeld.

In this patent a product display hanger is described which consists of a female socket which may be mounted in a wall or panel substrate. A hollow tubular hanger bar can be positioned in the female socket. Within the hollow tubular hanger bar there is a spring loaded pin, and the pin fits into a recess in the female socket, thereby holding the hanger bar in position.

This design requires the use of a tubular member of considerable diameter, both to provide adequate strength as a hanger bar for heavy items and also at the same time, to provide adequate space for the location of the spring-loaded pin within the interior.

In addition, it is necessary that some form of operating button is provided on the tubular bar, by which the spring loaded pin may be operated.

For these reasons, the system illustrated in this patent represents a somewhat clumsy and expensive solution to the problem. At the same time, the use of a spring loaded retaining pin is always liable to malfunction and failure, and may result in the inadvertent displacement of the tubular bar from the recess, thereby dropping product on the floor, or otherwise being unsatisfactory.

For all of these reasons it is considered desirable to provide an improved and simplified form of dismountable product hanger bar, which does not depend on the use of internal springs and buttons, and which is nonetheless easily dismounted, moved and reinserted by in-store personnel without any special tools or equipment.

In addition to all of these desirable features, it is preferable that such an improved form of hanger shall be incorporated in a modular hanger system, the specifications and design of which may be varied at will from one customer to another, while using essentially the same components, at least as the main portions of the system.

BRIEF SUMMARY OF THE INVENTION

With a view to providing these various advantages the invention comprises a demountable hanger assembly, for mounting at various locations in a display panel, and comprising, a cylindrical socket member of predetermined diameter, a magnet mounted within said cylindrical socket member, hanger locating means mounted within said socket member adjacent to said magnet, a hanger member having a cylindrical portion adapted to make a snug sliding fit in said cylindrical socket member, and said cylindrical portion at least being formed of a magnetically sensitive material, adapted to be attracted to said magnet, a locating recess formed in said cylindrical member adapted to interfit with said locating member in said socket member, and a hanger portion extending outwardly from said cylindrical portion, for supporting objects therefrom, said hanger member being demountable from and mountable in said socket member, by manually separating said cylindrical member from said magnet.

The invention further provides that the socket member may be provided with an annular mounting flange adapted to fit on the surface of the display panel, with the socket recessed in the display panel.

A further feature of the invention is the retention of the magnet within the cylindrical socket member, by means of the locating member, on one side of the magnet, and by means of an annular metallic member fitted into said socket on the other side of said magnet, said magnet thereby being secured on two sides within said cylindrical socket.

In a preferred case, the locating member is a linear transverse member extending across said socket member from one side to the other, and said cylindrical member is formed with a corresponding linear recess adapted to fit around said linear member, with said cylindrical member in contact with said magnet, for maximum retention and attraction thereto and the hanger is self-indexing.

Optionally the hanger member may simply be cylindrical rod, and there may be any form of product locating means such as an annular recess in the free end of the cylindrical rod, for retaining a product hanger in position.

In other cases, the hanger members may be a variety of different shapes and constructions for hanging various different types of product, and the invention is not restricted solely to the use of a cylindrical rod hanger.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
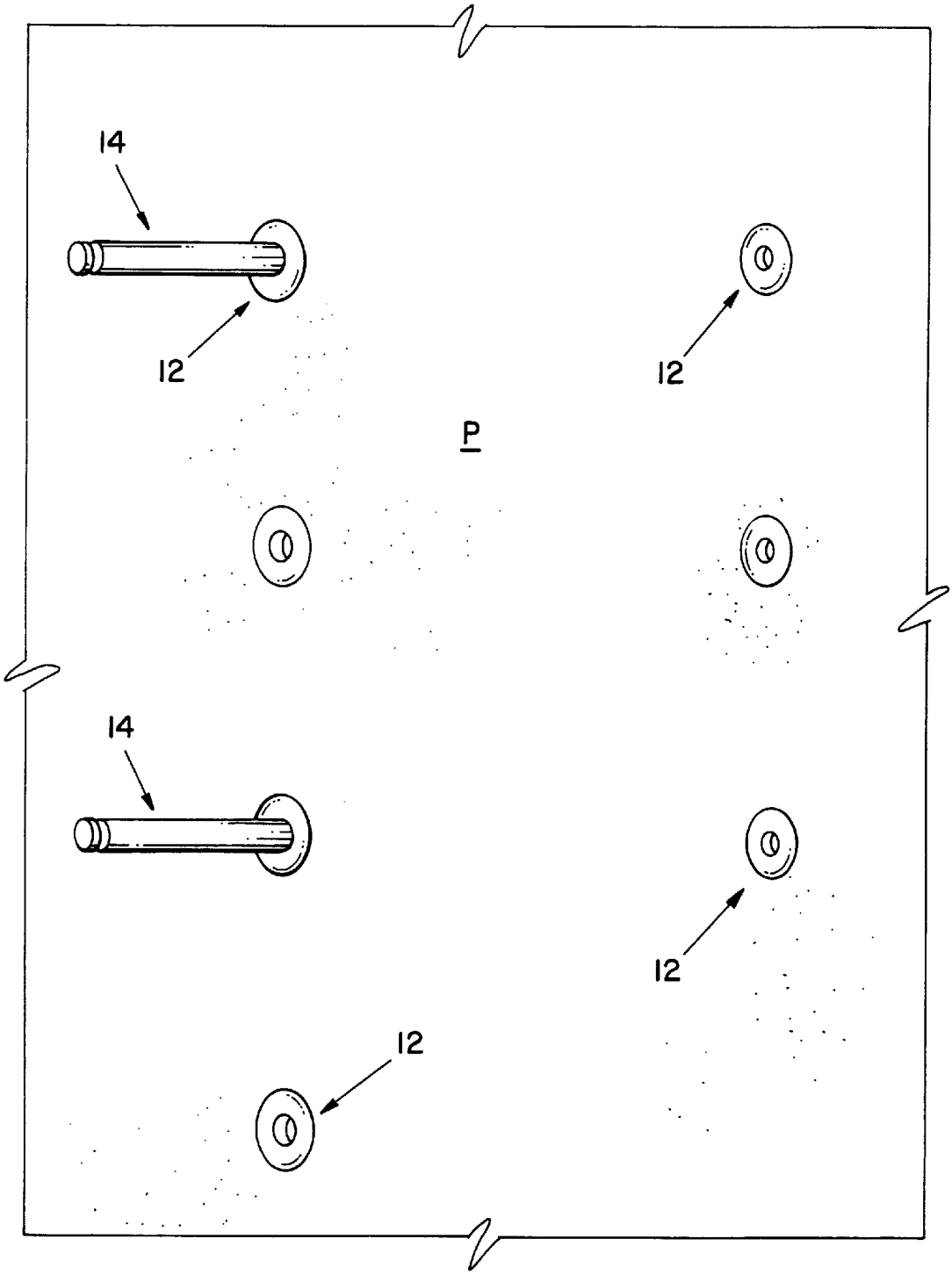
FIG. 1 is general perspective illustration of a typical store display panel, showing the use of various forms of demountable hanger assemblies illustrating the uses of the invention.
Figure 2:
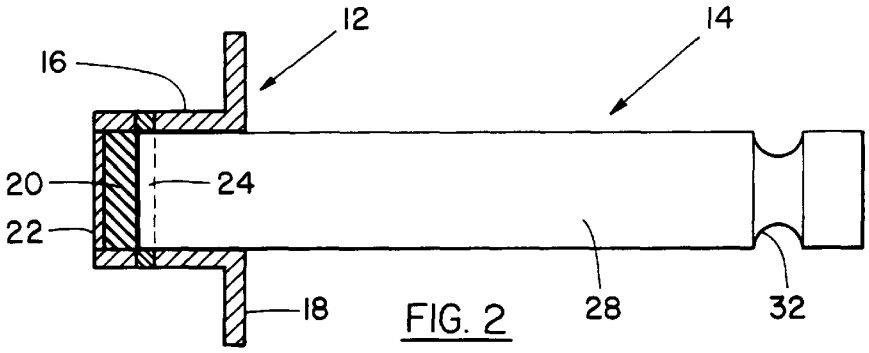
FIG. 2 is a side-elevational view of one form of demountable hanger assembly, with the socket shown in section.
Figure 4:
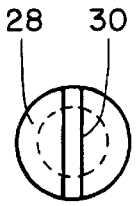
FIG. 4 is an end view of the cylindrical hanger rod, showing the locating recess.

Referring first of all to FIG. 1, the invention is there illustrated in the form of a plurality of demountable hanger assemblies each indicated generally as 10A, 10B, 10C and so on.

Each of the demountable hanger assemblies is shown in what is described for purposes of this explanation only as a "display panel". This of course may be on the inside of an exterior wall of a building space, or it may be a display panel erected in the interior of a building space, in the form of a partition or the like. Such a display panel may simply be in the form of drywall, in the case of an exterior wall covering or the drywall may be covered with some form of heavier duty load bearing panels, and in the case of an interior panel system, the display panel may be of any form of construction, adequate to carry the weight of the articles to be displayed.

According to this particular explanation, the term "display panel" is intended to encompass all forms of wall or panelling system on which products may be displayed, and is used herein as a generic term without limitation.

As better illustrated in FIGS. 2, 3, 4 and 5, one form of demountable display assembly is shown there for the purposes of illustrating the invention. It will be seen to comprise a mounting socket member indicated generally as 12, and a hanger member indicated generally as 14.

Figure 3:
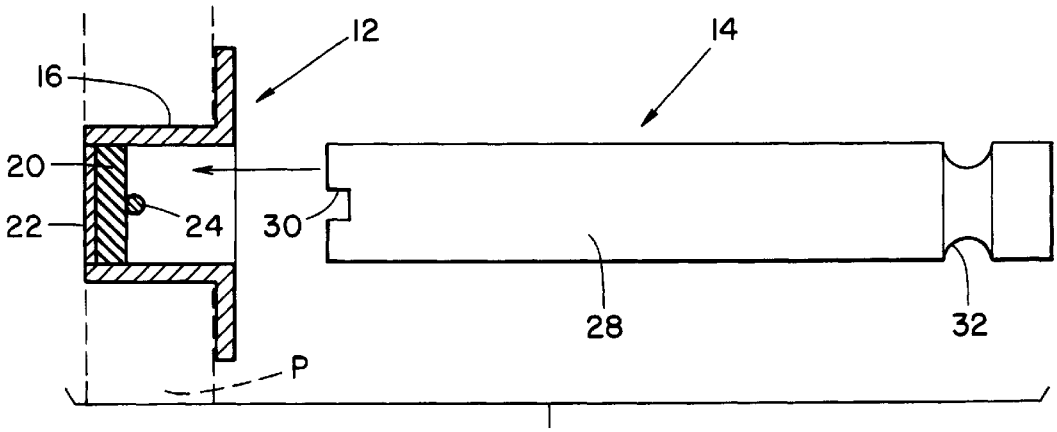
FIG. 3 is an exploded view corresponding to FIG. 2, but rotated 90 degrees.

The mounting socket member in this illustration comprises a generally cylindrical metallic socket 16, in this case having a generally annular facing flange 18, which is adapted to lie against the surface of a panelling member indicated in FIG. 3 in phantom as P.

The cylindrical socket 16 has retained within it a generally circular disc shaped magnet 20, which is polarized north/south across its thickness, so that one planar surface is a north magnet and the other planar surface is a south magnet. The magnet 20 will be a permanent magnet formed of materials adapted to retain their magnetism for an extended period of time.

The socket 12 is open at both ends, and at the magnet end, there is provided an annular retaining disc 22, which will typically be a snug pressure fit, but may be retained by means of welding or any other suitable retention system.

In front of the magnet 20, there is provided a locating or indexing pin 24 extending through registering holes 26 on opposites sides of the cylindrical socket 16. In this way, the cylindrical disc shaped magnet 20 is held in position on both its front and its rear surface within the socket 16, without the need of any other fastening.

It will now be appreciated that the socket 16 may receive a variety of different hanger members. The particular hanger member illustrated in FIGS. 2, 3, 4 and 5 comprises, simply for the sake of illustration, an elongated linear cylindrical rod 28 formed of solid steel, and having a diameter at its inner (left-hand in FIGS. 2 and 3) adapted to make a snug sliding fit within socket 16.

At its (left-hand) end the rod 28 is formed with a transverse linear locating recess 30, extending across the diameter of the rod, and in this particular case of generally rectangular shape in section, although the shape is not critical, but having a depth and width sufficient to receive the locating pin 24, and to allow the left-hand end of the rod 28 to seat firmly against the magnet 20.

In this way, once the left-hand of the rod 28 is slid into the socket 16, and the rod is rotated so that the recess 30 fits over the locating pin 24, the rod is securely held by magnetic attraction, and metal to metal contact, with the magnet 20.

The rod 28 is thus held indexed in position and secure against rotation in the socket 16, and is also securely held in the socket by the magnetic attraction of the magnet 20, so that the rod 28 cannot become inadvertently displaced.

The strength of the magnet 20 however is so arranged that a person can grasp the rod 28 and by pulling the rod 28 straight out of the socket 16, the rod 28 will release from the magnet.

The rod 28 can then be stored, or for example placed in another such socket 16 at a different location, thereby enabling the appearance and arrangement of the product hanging from the rod 28 to be readily changed without disturbing any of the fixtures in the space.

One further feature of the particular hanger rod 28 illustrated is the annular semi-cylindrical groove 32 formed at the free end of the rod 28. The purpose of this is so as to enable a typical product hanger for example such as a coat hanger or the like, to be positioned with its hook (not shown) in the semicylindrical groove 32, and in this way the product is attractively displayed away from the display panel P, but will not become inadvertently displaced from the rod 28, or drop to the ground.

Figure 5:
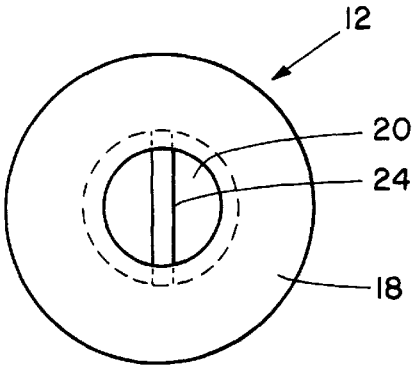
FIG. 5 is a front elevational view of the socket portion of the hanger assembly, according to one embodiment.

It will be appreciated from FIG. 5 that the socket flange 18 is merely provided as an attractive finish, facing the exterior of the panel. In this embodiment, the socket 16 is intended to be embedded in a fairly substantial thick panel and secured in position for example by means of adhesive or the like (not shown).

Figure 6:
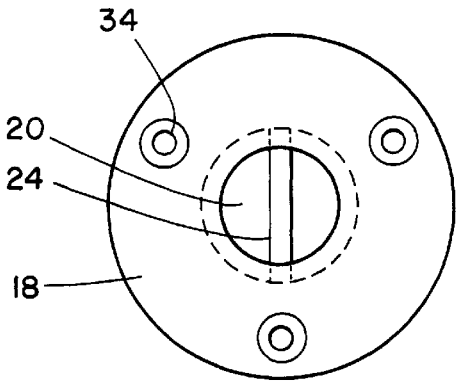
FIG. 6 is a front elevational view of a socket assembly according to another embodiment of the invention.

However, in some cases it is desirable to use the flange 18 as the means of securing the socket in the display panel. In this case, as shown in FIG. 6, the flange may be provided with a plurality of screw holes 34, so that the socket 16 may be secured in position by means of typical screws or other fastenings (not shown).

As already explained above, FIGS. 1 through 6 illustrate a particular form of hanger member of solid cylindrical rod construction.

However, it will be appreciated that numerous other forms of hanger members may be devised for use with the sockets according to the invention.

Such alternative hanger members are illustrated in FIGS. 7 to 14.

Figure 7:
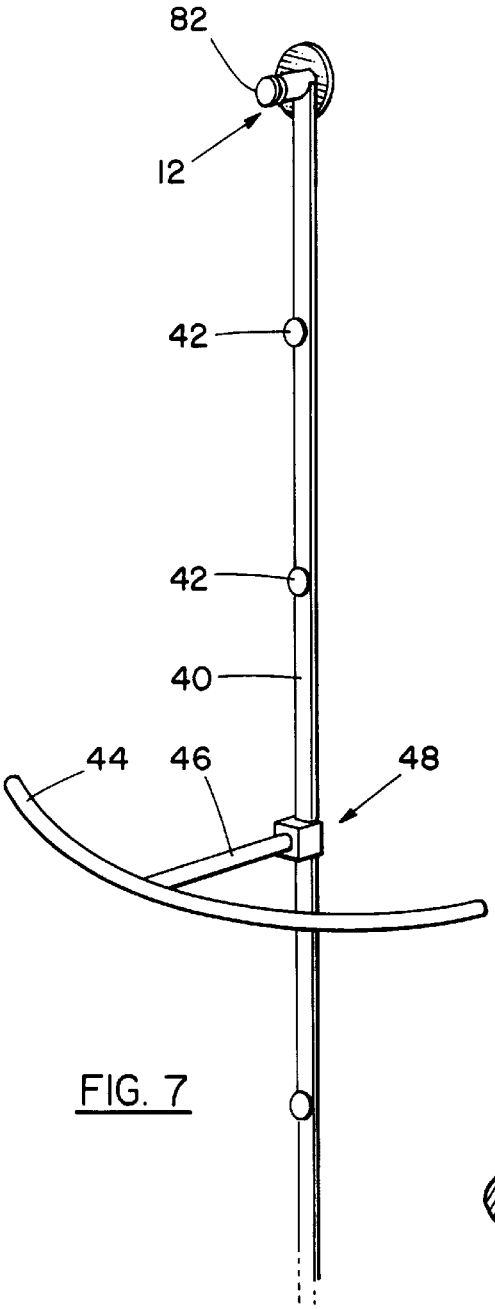
FIG. 7 is a perspective illustration of a further embodiment of a hanger system illustrating the invention.
Figure 8:
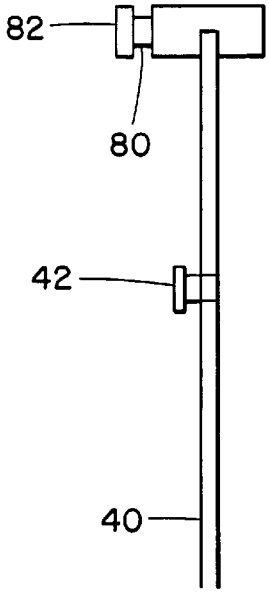
FIG. 8 is a section along the line 8—8 of FIG. 7.
Figure 9:
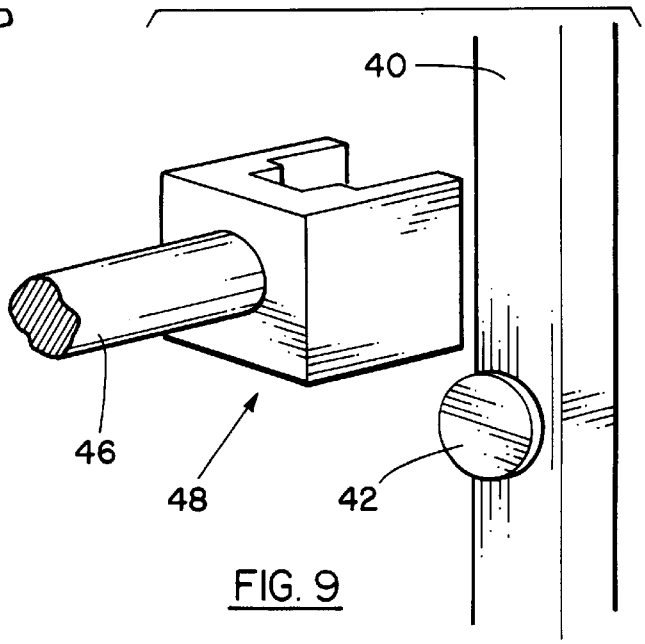
FIG. 9 is an exploded perspective illustration of a portion of the system of FIG. 7.
Figure 10:
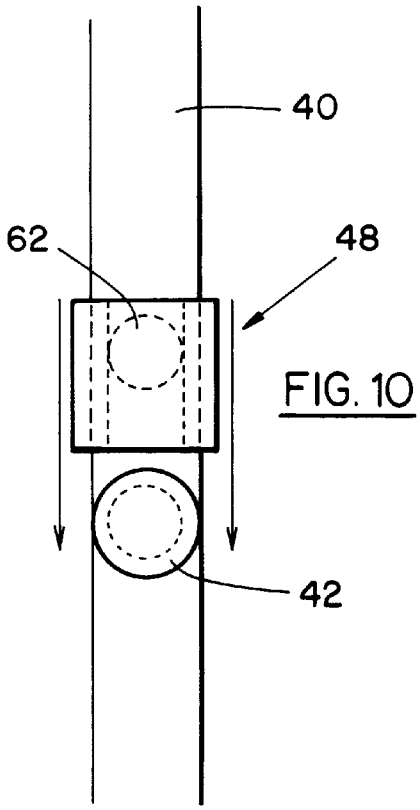
FIG. 10 is a further illustration in a front elevation illustrating the mode of use of the attachment of FIG. 9.
Figure 11:
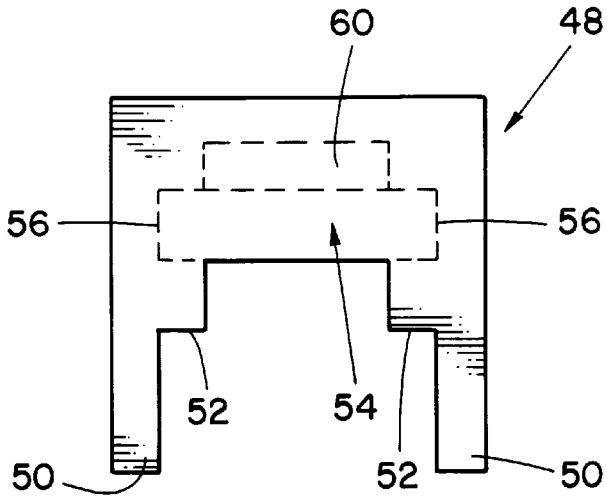
FIG. 11 is a section along the line 11—11 of FIG. 10.
Figure 12:
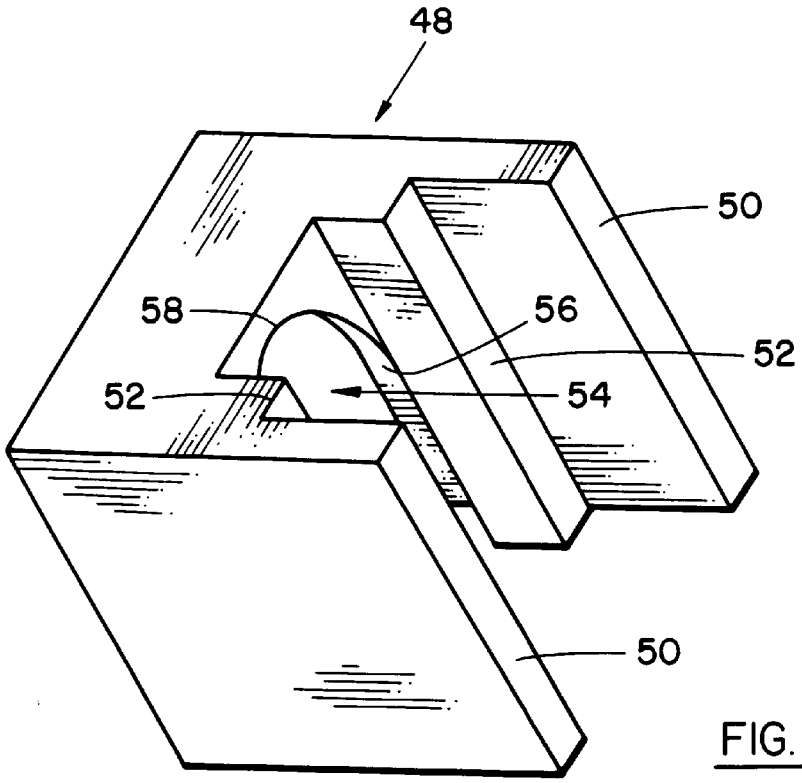
FIG. 12 is a perspective illustration of the attachment of FIGS. 10, 11 and 12.

Referring first of all to FIG. 7, that illustration shows a vertical hanger strap 40, on which there are secured a plurality of hanger attachment knobs 42 (FIG. 8). The strap 40 is of generally rectangular construction, and the knobs 42 are simply passed through suitable openings in the straps 40 and welded in position at spaced intervals. They have enlarged circular disc-like heads or buttons for reasons to be described below.

The straps 40 are used to support one or more product display arms or bars indicated generally as 44. The arms or bars 44 are shown to be of generally arcuate shape, but can be linear, and can be horizontal or can be sloping, or can be any one of a variety of different shapes which may be used to display a variety of different articles in an artistic and attractive manner.

The arms 44 are supported on rods 46.

Rods 46 are in turn supported for example by welding on generally cube shaped hanger attachment mounts 48. The hanger attachment mounts 48 are designed to fit over the straps 40, and to be secured in a vertical direction by means of interengagement with the knobs 42.

For this purpose, the hanger mounts 48 are formed in a generally channel shape defined by two arms 50—50, which are parallel to one another and are spaced apart to fit snugly over the sides of the strap 40. Interior ledges 52—52 engage the front surface of the strap 40.

Within the interior of the hanger support 48, a generally U-shaped slotted recess 54, is defined by two side channel portions 56—56, and a U-shaped closed end 58.

A generally circular magnet recess 60 is formed, in communication with the recess 54 (FIG. 11), and this is dimensioned to receive a cylindrical disc-shaped permanent magnet 62, similar to the magnets already described in connection with the sockets 12.

It will thus be apparent (FIG. 10) that by placing the arms 50—50 around the sides of the strap 40, and sliding the hanger support 48 downwardly over the knob or button 42, the head of the button will be received in the channel side walls 56—56. The U-shaped end 58 of the recess 54 will prevent further downward movement. The magnet 62 will attract to the head of the button 42 and hold the support 48 in position on the strap 40.

It will of course be appreciated that while in FIG. 7 only one such hanger support 48 and only one hanger bar 44–46 is shown, there may be a plurality of such supports and hanger bars mounted on the strap at each of the respective knobs 42. The hanger bars as stated may be of a variety of different designs, and they may be made so as to hold planar display panels (not shown) of glass or the like, so that the entire hanger display forms part of a adaptable system capable of presenting attractive, appealing displays in a variety of different ways.

The strap 40 is supported against the surface of a panel or wall, from a socket indicated generally as 12 (FIG. 7). This socket is the same as the socket 12 shown in FIGS. 2 through 6.

Figures 13, 14:
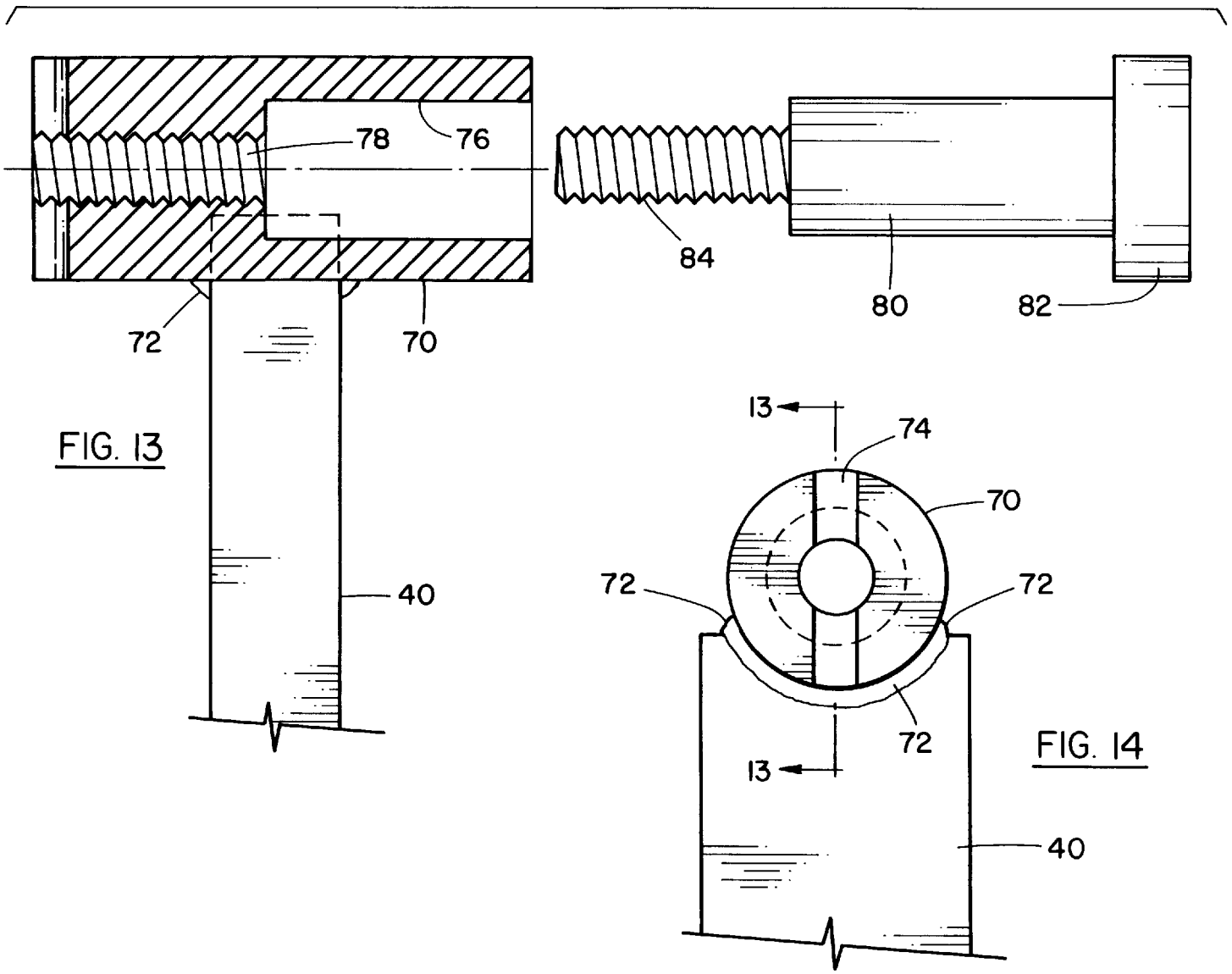
FIG. 13 is an exploded side elevational view partially in sections showing a further form of hanger bar attachment for use with the embodiment of FIG. 7; and, FIG. 14 is a section along the line 14—14 of FIG. 13.

In order to support the strap 40, there is secured at the top end of the strap 40, a mounting sleeve 70. Sleeve 70 is secured to the top end of strap 40 by means such as welding indicated generally as 72. The sleeve 70 is at right angles to strap 40, and is therefore substantially horizontal. The sleeve 70 is formed at its inward (left-hand) end with a linear transverse locating slot 74 (FIG. 14). The locating slot 74 is adapted to engage the locating pin 24 within the socket 12 in the manner described above.

The support sleeve 70 is formed with a generally cylindrical counter-bore 76, and an internally threaded through bore 78.

In order to provide a finished appearance for the sleeve 70, a cylindrical plug member 80 is provided, adapted to fit snugly within counter-bore 76.

An enlarged button head 82 is formed on the outer (right-hand) end of plug 80, to provide a uniform appearance to the hanging strap 40.

A male threaded member 84 extends from the left-hand end of plug 80 and is adapted to be threaded into the threaded through bore 78 in sleeve 70.

In use the plug 80 and threads 84 are fitted into the sleeve 70, and the plug 80 will be screwed in until the left-hand end of the male threaded member 84 reaches the transverse slot 74.

At this point, the threaded member 84 will be obstructed, since it will meet the linear locating member 24 of the sleeve 12.

In the event that it is found necessary to remove the strap 40 from its position hanging from the socket 12, then a person can simply manually grasp the knob 82 and rotate the plug 80 and threads 84 until they press against the locating member 24. Further rotation of the plug 80 will cause the left-hand end of sleeve 70 to separate from the magnet 20 within the socket 12, and the entire assembly of the strap 40 and the sleeve 70 can then simply be withdrawn from the socket 12, since the magnetic attraction has been broken, and the strap 40 can then be either removed or replaced in another location as desired.

It will of course be appreciated that in view of the modular nature of the strap 40 and the hangers 44 and 46 and the supports 48, the supports 48 can readily be separated from their magnetic hold on the buttons 42, and be moved around or replaced by a variety of other hangers or display members (not shown) so as to provide a completely modular and fully adjustable system, enabling a store owner to arrange his display in whatever manner he pleases.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A demountable hanger assembly, for mounting at various locations on a display panel, comprising;

a cylindrical socket member of predetermined diameter defining a predetermined length and defining and open end and a closed end and a smooth cylindrical wall extending there between;

a planar disc-shaped magnet mounted at said closed end of said cylindrical socket member;

hanger locating abutment member mounted within said socket member adjacent to said magnet, and spaced towards said pen end of said socket member;

a hanger member having a cylindrical portion adapted to make a snug sliding fit in said cylindrical socket member adjacent said smooth cylindrical side wall thereof, and said cylindrical portion at least being formed of a magnetically sensitive material, adapted to be attracted to said magnet at said closed end of said socket member whereby to secure said hanger member supported from said socket member;

a locating recess formed in a free end of said cylindrical portion shaped and adapted to interfit with said locating abutment member in said socket member; and, said hanger member extending outwardly from said socket member, for supporting objects therefrom, said hanger member being demountable from said socket member, by manually separating said cylindrical portion from said magnet.

2. A demountable hanger assembly as claimed in claim 1 wherein the socket member is provided with an annular mounting flange adapted to fit on the surface of a display panel.

3. A demountable hanger assembly as claimed in claim 1 wherein the locating abutment member is positioned on one planar side of the magnet, and wherein the closed end of the socket member is formed by an annular metallic member fitted into said socket member on the other planar side of said magnet, said magnet thereby being secured on two plan sides within said cylindrical socket member.

4. A demountable hanger assembly as claimed in claim 1 wherein the locating abutment member is a linear transverse member extending across said socket member from one side to the other, and said cylindrical portion is formed with a corresponding linear recess adapted to fit around said linear member, with said cylindrical portion in contact with said magnet, for maximum retention and attraction thereto and indexing of cylindrical portion.

5. A demountable hanger assembly as claimed in claim 1 wherein the hanger member is a cylindrical rod and includes an annular recess in the free end of the cylindrical rod for retaining a product hanger in position.

6. A demountable hanger assembly as claimed in claim 1 wherein said magnet is polarised across its thickness whereby one planar surface is of one polarity and the other planar surface is of opposite polarity.

7. A demountable hanger assembly as claimed in claim 6 wherein said magnet is held in position in said socket member by said locating abutment member on one planar surface, and by a retention member, which forms the closed end of said socket member, on the other planar surface.

8. A demountable hanger assembly as claimed in claim 7 wherein said locating abutment member is a linear rod secured across the diameter of said socket member in openings in opposite sides of said socket member, and wherein said retention member is a planar metallic member secured in said socket member.

9. A demountable hanger assembly as claimed in claim 1, including a hanger strap supported from said socket member, and hanger mounting means on said strap at spaced intervals there along.

10. A demountable hanger assembly as claimed in claim 9 wherein said strap defines upper lower ends, and including a support sleeve secured to said upper end of said strap, said support sleeve being shaped to fit in said socket member adjacent said smooth cylindrical side wall there of, and to be retained therein by magnetic attraction to said magnet therein.

11. A demountable hanger assembly as claimed in claim 10 including a threaded through bore in said support sleeve, and a threaded member received in said through bore, rotation of said threaded member advancing said threaded member through said sleeve into contact with said locating abutment member in order to break the magnetic attraction between said support sleeve and said magnet.

12. A demountable hanger assembly as claimed in claim 11 wherein said threaded member has a smooth cylindrical portion adapted to extend outwardly from said sleeve, and a button formed on the outward end of said cylindrical portion.

13. A demountable hanger assembly as claimed in claim 11 including an indexing recess formed transversely in the inner end of said cylindrical sleeve for registration with said locating abutment member in said socket member whereby said inner end can contact said magnet for maximum magnetic attraction thereto.

14. A demountable hanger assembly as claimed in claim 9 including product bar attachment means moveably attachable to a said hanger mounting means on said strap.

15. A demountable hanger assembly as claimed in claim 14 including a product hanger bar attached to said product bar attachment means.

16. A demountable hanger assembly as claimed in claim 15 wherein said hanger mounting means on said strap include rod portions secured to said strap and buttons formed on the free ends of said rod portions and wherein said product bar attachment means includes a slotted recess having a blind end adapted to make a sliding fit over a said button and a magnet mounted in said attachment means adapted to cause magnetic attraction with said button, and thereby retain said attachment means in position.

* * * * *